US007500942B2

(12) United States Patent
Takahashi et al.

(10) Patent No.: US 7,500,942 B2
(45) Date of Patent: Mar. 10, 2009

(54) CENTRIFUGAL SEPARATOR WITH DOOR LOCK SAFETY DEVICE

(75) Inventors: Hiroyuki Takahashi, Hitachinaka (JP); Masahiro Inaniwa, Hitachinaka (JP); Sadato Igarashi, Hitachinaka (JP)

(73) Assignee: Hitachi Koki Co, Ltd., Tokyo (JP)

( * ) Notice: Subject to any disclaimer, the term of this patent is extended or adjusted under 35 U.S.C. 154(b) by 0 days.

(21) Appl. No.: 11/858,558

(22) Filed: Sep. 20, 2007

(65) Prior Publication Data

US 2008/0132395 A1 Jun. 5, 2008

Related U.S. Application Data

(63) Continuation-in-part of application No. 11/336,847, filed on Jan. 23, 2006, now Pat. No. 7,288,060.

(30) Foreign Application Priority Data

Jan. 24, 2005 (JP) ..... 2005-014931
Aug. 10, 2007 (JP) ..... 2007-209159

(51) Int. Cl.
*B04B 7/06* (2006.01)

(52) U.S. Cl. ..... 494/12; 494/16

(58) Field of Classification Search ..... 494/1, 494/7–12, 16–21, 84; 210/85, 144, 363
See application file for complete search history.

(56) References Cited

U.S. PATENT DOCUMENTS 3,633,041 A 1/1972 Koskela
3,699,287 A 10/1972 Stahl et al.
5,280,975 A 1/1994 Tscheu et al.
6,241,650 B1 6/2001 Letourneur
6,334,841 B1 1/2002 Letourneur
6,602,178 B2 8/2003 Inaniwa et al.
7,104,944 B2 9/2006 Fujimaki et al.
7,278,961 B2 * 10/2007 Takahashi et al. ..... 494/12
7,288,060 B2 * 10/2007 Takahashi ..... 494/12
7,311,653 B2 * 12/2007 Kusumoto ..... 494/16
7,396,324 B2 * 7/2008 Tetsu et al. ..... 494/16
2006/0166801 A1 7/2006 Takahashi
2006/0178253 A1 8/2006 Takahashi et al.
2008/0132395 A1 * 6/2008 Takahashi et al. ..... 494/7
2008/0220958 A1 * 9/2008 Hayasaka et al. ..... 494/12

FOREIGN PATENT DOCUMENTS

CN 2093192 U 1/1992
DE 2816395 10/1979
JP 60-20753 6/1985
JP 7-275738 10/1995
JP 9-187428 7/1997
JP 2001-87677 4/2001
JP 2006-198564 8/2006

* cited by examiner

*Primary Examiner*—Charles E Cooley
(74) *Attorney, Agent, or Firm*—Mattingly, Stanger, Malur & Brundidge, P.C.

(57) ABSTRACT

A centrifugal separator is configured such that a switching unit adapted to be brought into electrical conduction or electrical nonconduction is electrically connected in a drive power supply line between a motor drive circuit of a control unit and a motor winding wire, and that the switching unit is controlled to be brought into nonconduction when a door is opened.

14 Claims, 7 Drawing Sheets

CENTRIFUGAL SEPARATOR WITH DOOR LOCK SAFETY DEVICE

The present application is a continuation-in-part application (CIP) of U.S. patent application Ser. No. 11/336,847, filed on Jan. 23, 2006, now U.S. Pat. No. 7,288,060 B2, which is herein incorporated by reference, and is also based on and claims the benefit of priority from the prior Japanese Patent Application No. 2007-209159, filed on Aug. 10, 2007; Japanese Patent Application No. 2005-014931, filed on Jan. 24, 2005; the entire contents of which are incorporated herein by reference.

BACKGROUND OF THE INVENTION

1. Field of the Invention

The present invention relates to a structure for securing the electrical safety of a centrifugal separator.

2. Description of the Related Art

The centrifugal separator is configured so that a rotor caused through a tube and a bottle to hold a sample to be separated is accommodated in a rotor chamber (rotating chamber), and that the rotor is rotated at high speed by a drive unit, such as a motor, in a case where an opening portion of the rotor chamber is hermetically closed by a door, to thereby separate and purify the sample held by the rotor. The rotational speed of the rotor varies with the use thereof. Generally, there are provided families of products having rotational speeds that widely range from a relatively low speed, the maximum value of which is about several thousands revolutions per minute (rpm), to a high speed, the maximum value of which is about 150,000 rpm.

FIG. 6 shows the configuration of a known centrifugal separator. The centrifugal separator comprises a motor housing (casing) 5 of a motor 5*a* serving as a rotary drive source, a rotating spindle (a shaft) 5*b* rotatably connected to the motor 5*a*, a rotor 1 fixed to the rotating shaft 5*b* and adapted to hold a sample to be separated, a rotor chamber 2 adapted to accommodate the rotor 1 and to have an opening portion 2*a* in the top surface thereof, a door 3 openably/closeably provided in the opening portion 2*a* of the rotor chamber 2, a door lock mechanism 4 adapted to restrict the opening/closing of the door 3, a door opening/closing detector 12 adapted to detect the opening/closing of the door 3, and a control unit 60 adapted to control the motor 5*a* and the door lock mechanism 4. The motor housing 5, the rotor chamber 2, the door lock mechanism 4, and the control unit 60 are accommodated in a casing (frame) 10.

When the door 3 of the rotor chamber 2 is opened in such a centrifugal separator, a user may touch the rotating shaft 5*b* of the motor 5*a* and the rotor 1 that may electrically be conducted to the rotating shaft 5*b*. Thus, generally, an electrically insulating layer is provided between the winding of the motor 5*a* and the rotating shaft 5*b* to thereby prevent a user from getting an electrical shock.

Further, to prevent a power supply voltage from being generated on the rotating shaft 5*b* even when such an insulating layer may cause dielectric breakdown, an electric shock guard means is doubled by electrically grounding the motor housing 5 of the motor 5*a* through a ground connection wire 8. Usually, the casing 10 of the centrifugal separator is connected to a ground connection wire 9. Thus, the ground connection wire 8 of the motor housing 5 is electrically connected to a part of the casing 10 of the centrifugal separator placed in the vicinity of the motor housing 5. Incidentally, the value of a leakage current of the centrifugal separator is limited to a value, which is predetermined according to JIS (Japanese Industrial Standards) safety standard or to IEC (International Electrotechnical Commission) safety standard not to seriously affect a human body, or less (for instance, 3.5 mA or less). Also, it is required to place a plurality of electric shock guard means at members of a centrifugal separator, which have possibilities of being touched by users. Also, it is prescribed that in a case where an insulation part is used as the electric shock guard means, the insulation part should have a high withstand voltage (for instance, 1300V or higher).

However, in some condition in which the centrifugal separator is used, a user may use the centrifugal separator in an environment in which no grounding equipment is provided.

In this case, the aforementioned electric shock guard means utilizing the grounding cannot be employed. Thus, an insulation transformer 13 is used as another ordinary electric shock guard means, as illustrated in FIG. 5, to thereby ensure safety. Also, sometimes, a method of performing double insulation or reinforced insulation on the casing of the motor itself by using an insulating layer to insulate the winding of a motor is performed as a still another means for assuring safety.

Incidentally, regarding the related art, JP-UM-B-60-20753 discloses the technique of preventing occurrence of an electric shock by providing an electrical insulating layer between the rotor winding and the rotating shaft of a motor, or what is called a double insulation technique of constructing also a motor casing by an insulating material. Further, JP-A-9-187428 discloses the technique of preventing the generation of a leakage current by using the insulation transformer. Furthermore, JP-A-2001-87677 discloses the technique of constituting a centrifugal separation rotor attached to the rotating shaft of a motor by an insulating material to thereby ensure safety in a case where a user touches the rotor and so on.

However, the structure using the aforementioned insulation transformer 13, and the structure of the motor 5*a*, to which the double insulation or the reinforced insulation is applied, are advantageous in a case where the ground connection wire 9 is not ground-connected, such structures have a problem that the structures cause an increase in the cost of the centrifugal separator. Further, the technique described in the aforementioned JP-A-2001-87677 is subjected to a constraint that the process material of the rotor is an insulating material. Thus, it is difficult to combine a rotor, which is made of a generally used metallic material, with a centrifugal separator body.

Furthermore, when the aforementioned insulation transformer is used or when the double insulation or the reinforced insulation of the motor is performed thereon, not only the employment of a plurality of electric shock guards but that of countermeasures to limit the value of a leakage current (an electric current flowing through the body of a user when the user touches the rotor) generated through floating capacity (stray capacitance) to a leakage current value, which is determined according to the safety standards, or less is performed.

SUMMARY OF THE INVENTION

Accordingly, an object of the invention is to provide a centrifugal separator enabled by employing a relatively simple configuration to reduce a leakage current and realize double prevention of occurrence of an electric shock without using the high-cost insulation transformer and without the double insulation or the reinforced insulation structure of the motor and without additional countermeasures to reduce a leakage current.

The above and other objects and novel features of the invention will become more apparent from the following description and the accompanying drawings.

Inventors of the present invention focus attention on the following specificities of the centrifugal separator and have created the present invention. That is, usually, the centrifugal separator is configured so that during an operation thereof, the door of the rotor chamber is locked and is inhibited from opening, thereby to ensure safety against unexpected mechanical damage in operation. Therefore, the inventors focus attention on the fact that because the door is closed, a user of the centrifugal separator cannot touch the rotating shaft of the motor and the rotor in operation, so that occurrence of an electrical shock due to the user's touch on the motor or on the rotor can be prevented. Consequently, the electric shock guard can be doubled. Thus, the grounding of the motor housing can be omitted. Meanwhile, when the centrifugal separator is stopped, a user can open the door and touch the rotor and so on. Thus, the motor housing having neither a double insulation structure nor a reinforced insulation structure needs ground connection. However, when the centrifugal separator is stopped, it is unnecessary to rotate the motor, so that the separation of the motor drive circuit from the power supply can be utilized as an electric shock guard means. Therefore, in both of a case where the centrifugal separator is operated, and a case where the centrifugal separator is stopped, this electric shock guard means is added to the insulation structure provided between the winding wire and the rotating shaft of the motor, so that a plurality of electric shock guard means can be realized.

Outlines of the representative aspects of the invention disclosed in the present application are described as follows.

(1) According to an aspect of the invention, there is provided a centrifugal separator having a motor housing that incorporates a motor serving as a rotary drive source; a rotating shaft connected to the motor; a rotor fixed to the rotating shaft and adapted to hold a sample to be separated; a rotor chamber adapted to accommodate the rotor and to have an opening portion in a top surface thereof; a door openably/closeably provided in the opening portion of the rotor chamber; a door lock mechanism adapted to restrict the opening/closing of the door; a control unit adapted to control the motor and the door lock mechanism; a casing adapted to accommodate the motor housing, the rotor chamber, the door lock mechanism, and the control unit, and to have an open part at the opening portion in the top surface of the rotor chamber so that the door is openably and closeably provided in the open part; and a switching unit, which is adapted to be brought into electrical conduction or electrical nonconduction, being electrically connected to a line for supplying power to the motor, the line connecting the control unit and the motor, wherein, when the door lock mechanism does not lock the door, the switching unit is brought into electrical nonconduction.

(2) An embodiment of the centrifugal separator of the invention described in the item (1) features that the switching unit is controlled by the control unit to be brought into electrical nonconduction when the door lock mechanism does not lock the door.

(3) According to another aspect of the invention, there is provided a centrifugal separator having a motor housing that incorporates a motor serving as a rotary drive source; a rotating shaft connected to the motor; a rotor fixed to the rotating shaft and adapted to hold a sample to be separated; a rotor chamber adapted to accommodate the rotor and to have an opening portion in a top surface thereof; a door openably/closeably provided in the opening portion of the rotor chamber; a door opening/closing detector adapted to detect opening/closing of the door; a control unit adapted to control the motor; a casing adapted to accommodate the motor housing, the rotor chamber, the door lock mechanism, and the control unit, and to have an open part at the opening portion in the top surface of the rotor chamber so that the door is openably and closeably provided in the open part; and a switching unit, which is adapted to be brought into electrical conduction or electrical nonconduction, being electrically connected to a line for supplying power to the motor, the line connecting the control unit and the motor, wherein the switching unit is controlled to be brought into nonconduction when the door is opened.

(4) An embodiment of the centrifugal separator of the invention described in the item (3) features that when the door opening/closing detector detects the opening of the door, the switching unit is brought into nonconduction.

(5) An embodiment of the centrifugal separator of the invention described in one of the items (1) to (4) features that when the control unit does not control the motor, the switching unit is brought into nonconduction.

(6) An embodiment of the centrifugal separator of the invention described in one of the items (1) to (5) features that the switching unit is an electromagnetic switch.

(7) An embodiment of the centrifugal separator of the invention described in one of the items (1) to (6) features that the motor housing is electrically separated from the casing and is accommodated in the casing.

(8) An embodiment of the centrifugal separator of the invention described in one of the items (1) to (7) features that the rotor is made of a metallic material.

With the configuration of the centrifugal separator according to the invention described in the item (1), a switching unit adapted to be brought into electrical conduction or into electrical nonconduction is electrically connected in a motor drive power supply line connecting the control unit and the motor. When the door of the centrifugal separator is opened in a state in which a user can touch the rotor and the rotating shaft of the motor, the switching unit is made to be brought into nonconduction. Consequently, the electric shock guard means can be doubled by causing the nonconduction of electricity in the switching unit in addition to the insulation of the motor. Thus, the necessity for performing the addition of the insulation transformer and the double insulation or the reinforced insulation of the motor, which are needed by the related art, can be eliminated. Consequently, a low-cost centrifugal separator having a simple configuration can be provided. Meanwhile, when the motor is operated, the switching unit is brought into conduction. However, the door of the centrifugal separator is closed and is locked so that a user cannot touch the rotor and the rotating shaft of the motor. Thus, the electric shock guard means can be doubled by adding the locking of the door to the insulation of the motor.

Also, according to the invention described in the item (6), especially, an electromagnetic switch is used as the switch unit. Thus, when the electromagnetic switch is brought into nonconduction, a high withstand voltage (for example, 1300V or higher) developed between the terminals of the switch, which voltage is required to serve as the electric shock guard means, can easily be obtained. Further, as compared with a switch unit implemented by an electronic switch, such as a transistor, the floating capacity (stray capacitance) can be reduced. Thus, the suppression of the value of the leakage current, which is generated when a user touches the rotor and the rotating shaft of the motor during stopped, to a value, which is determined according to the JIS standard and the IEC standard, or less can be facilitated.

DETAILED DESCRIPTION OF THE PREFERRED EMBODIMENTS

Figure 1:
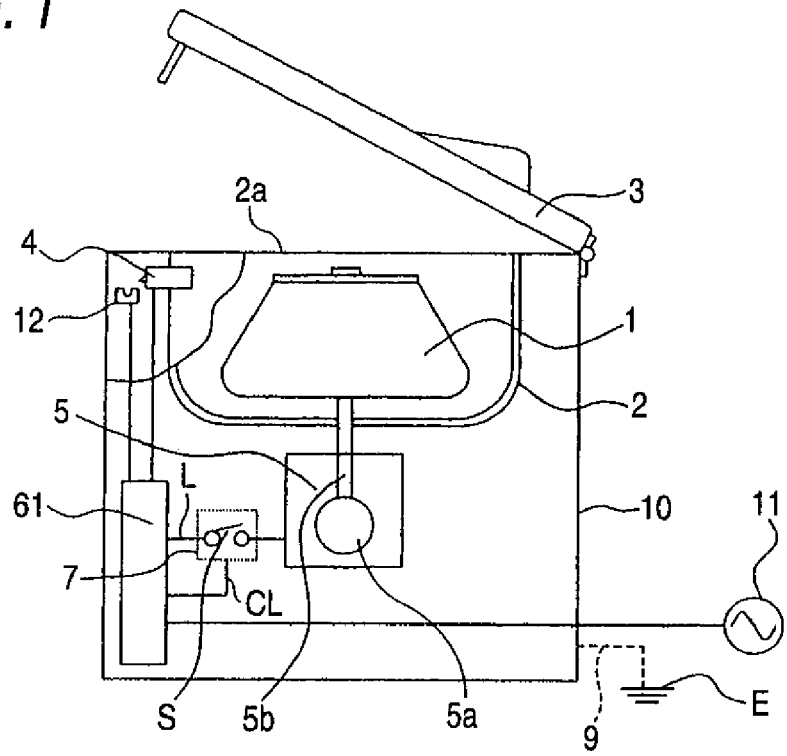
FIG. 1 is a view illustrating the configuration of a centrifugal separator according to an embodiment of the invention.

Hereinafter, embodiments of the invention are described in detail with reference to the accompanying drawings. Incidentally, same reference numerals designate members having the same functions throughout figures illustrating the embodiment.

Thus, redundant descriptions of such members are omitted herein.

Further, members having the same functions as those of corresponding members of the related art are denoted by the same reference numerals as those denoting the corresponding members.

Figure 2:
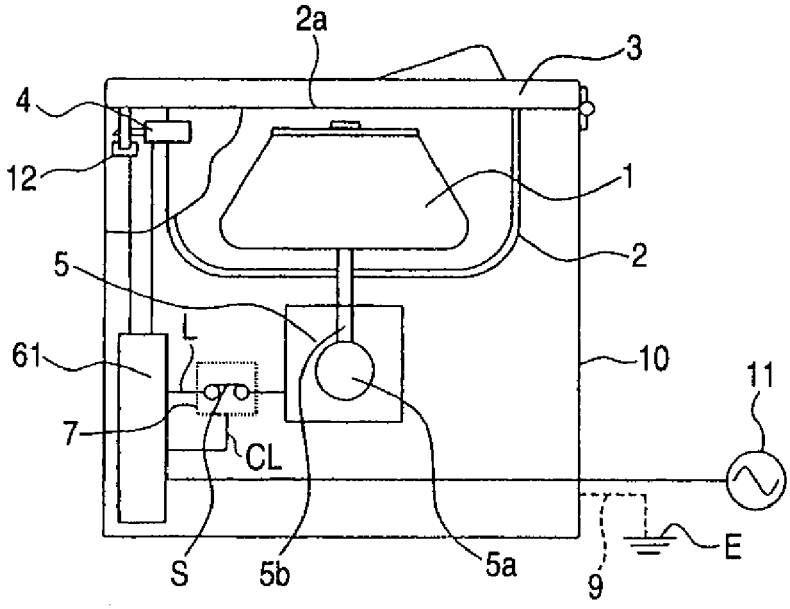
FIG. 2 is a view illustrating a state, in which a door is closed in the centrifugal separator according to the invention shown in FIG. 1.

FIGS. 1 and 2 are views illustrating the configuration of a centrifugal separator according to an embodiment of the invention. Particularly, FIG. 1 is a view illustrating a state in which a switching unit 7 is in a nonconductive state, and in which a motor 5*a* is stopped, so that a rotor 1 does not rotate.

Figure 6:
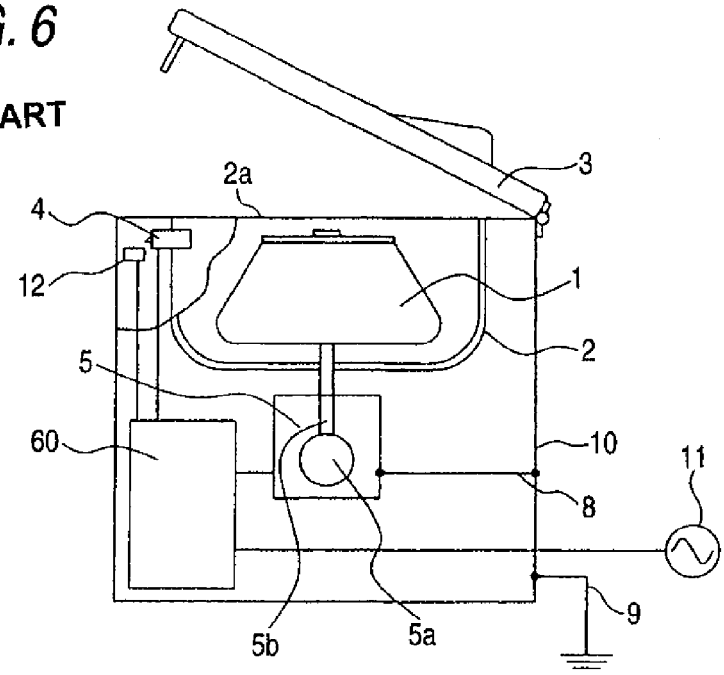
FIG. 6 PRIOR ART
FIG. 6 is a view illustrating the configuration of another example of a related centrifugal separator.

FIG. 2 is a view illustrating a state in which the switching unit 7 is in a conductive state and in which the motor 5*a* rotates, so that the rotor 1 is rotated. The centrifugal separator has a metallic casing (frame) 10, which is, for example, quadrangular in cross section viewed from top. The centrifugal separator also has a metallic motor housing (casing) 5 that incorporates the motor 5*a*, which serves as a rotary drive source. The centrifugal separator also has a metallic rotating spindle (shaft) 5*b* rotatably connected to the motor 5*a*, the rotor 1 that is made of a metallic material (for instance, an aluminum based alloy) and that holds a sample to be separated, a rotor chamber 2 that accommodates the rotor 1 and has an opening portion 2*a* in the top surface thereof, a door 3 capable of being opened and closed and provided in the opening portion 2*a* of the rotor chamber 2 that is formed in the casing 10, a door lock mechanism 4 adapted to restrain the opening/closing of the door 3, a door opening/closing detector 12 adapted to detect the opening/closing of the door, the switching unit 7 electrically connected to a supply line L of drive power for the motor 5*a*, and a control unit 61 adapted to control the motor 5*a*, the door lock mechanism 4, and the switching unit 7. These figures illustrate a state in which the casing 10 is not electrically connected to the earth E. Further, this embodiment of the invention is not provided with a ground connection wire (corresponding to the connection wire 8 shown in FIG. 6) adapted to electrically connect the motor housing 5 to the casing 10.

Figure 3:
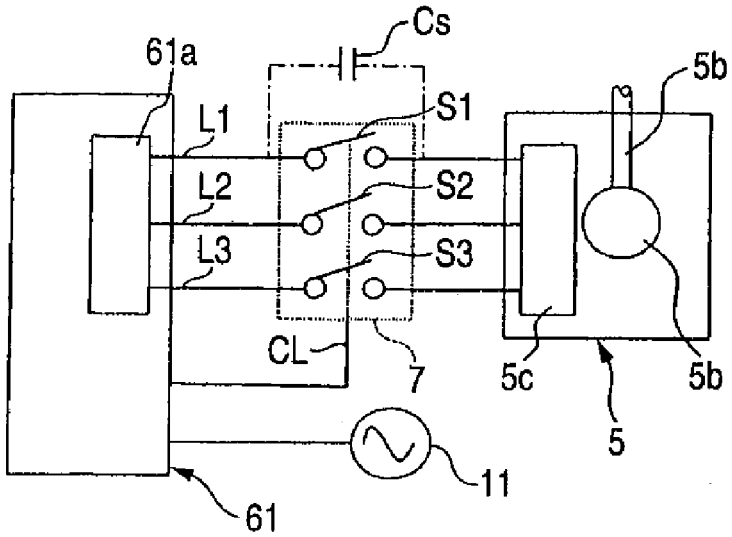
FIG. 3 is a view illustrating the configuration of a primary part of an example of the centrifugal separator shown in FIG. 1 according to the invention.

The motor 5*a* is constituted by, for example, a three-phase induction motor activated by a three-phase ac power supply that provides a voltage of 300V. An insulating layer is formed between the winding wire and the iron core of the motor 5*a* or on the outer peripheral surface of the rotating shaft 5*b* of the motor 5*a*. FIG. 3 illustrates a more practical connection relation between the motor 5*a* and the switching unit 7.

As shown in FIG. 3, the control unit 61 has a motor drive circuit 61*a*. The motor drive circuit 61*a* includes an inverter system and converts an ac power supply voltage supplied from an ac power supply 11, which is constituted by, for example, a commercial ac power supply providing a voltage of 100V or 200V (50/60 Hz), to a three-phase ac power supply voltage of 300V (5 Hz to 2.6 kHz) by using an inverter 61*a*. Thus, the three-phase ac voltages are outputted to lines L1, L2, and L3.

The switching unit 7 has a property of causing the conduction of electricity in (or connection of) or the nonconduction of electricity in (or interruption of) the line L in response to a control signal applied to the control terminal CL thereof.

Figure 4:
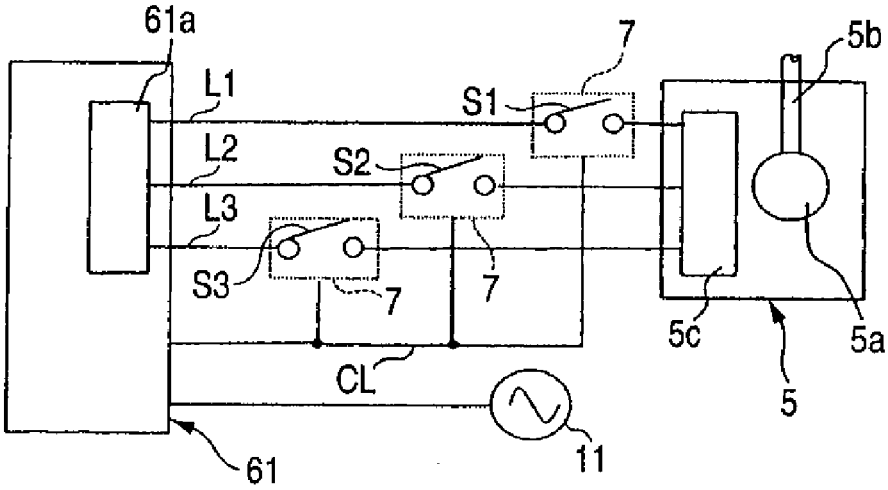
FIG. 4 is a view illustrating the configuration of a primary part of another example of the centrifugal separator shown in FIG. 1 according to the invention.
Figure 5:
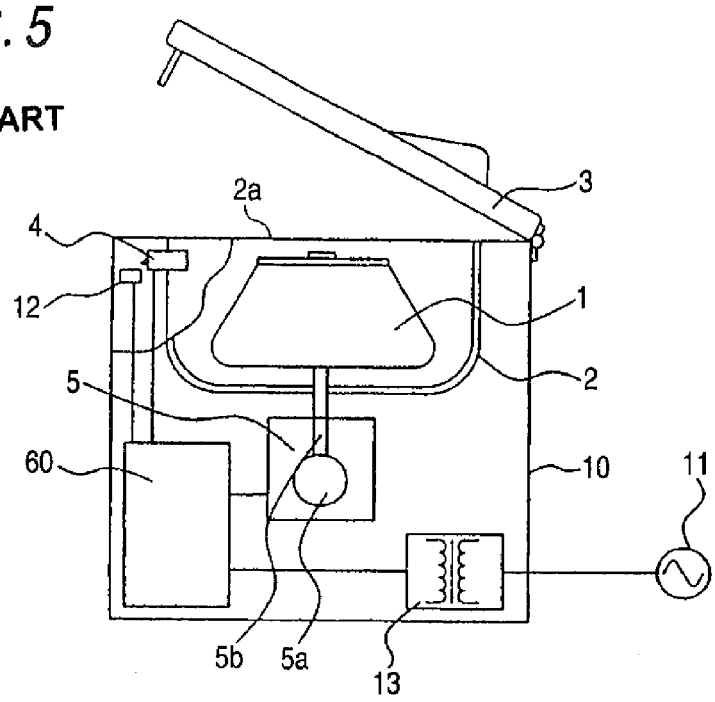
FIG. 5 PRIOR ART
FIG. 5 is a view illustrating the configuration of an example of a related centrifugal separator.

The switching unit 7 is constituted by an electromagnetic switch (an electromagnetic relay) in the preferred embodiment. FIG. 3 shows an example using the electromagnetic switch 7 of the triple throw type (the three-contact-point type). Three contact points S1, S2, and S3 of the electromagnetic switch 7 serving as the switching unit are connected to the drive power supply lines L1, L2, and L3, respectively. Three-phase ac power is supplied to a three-phase winding wire 5*c* of the induction motor 5*a* through these contact points. The control of the conduction of electricity in (or the connection of) or the nonconduction of electricity in (or the interruption of) each of the switches S1, S2, and S3 of the electromagnetic switch 7 is performed in response to a control signal to be applied to the control terminal CL of the electromagnetic switch 7 by the control unit 61. FIG. 4 illustrates another example of the configuration employing an electromagnetic switch as the switching unit 7.

The switching switch 7 shown in FIG. 4 is an example of using three electromagnetic switches of the one-contact-point type (S1, S2, and S3). Thus, the centrifugal separator can be configured similarly to the case shown in FIG. 3.

Next, an operation of the embodiment according to the invention is described below. The switching unit (the electromagnetic switch) 7 is controlled by the control unit 61 to be brought into a conduction state when the door is put into a closed state, as shown in FIG. 2, at the stage of an operation of the centrifugal separator. When the door opening/closing detector 12 detects the closed state of the door 3 after the door 3 is closed, or when the door 3 is locked by the door lock mechanism 4 after the door 3 is closed, each of the contact points S1, S2, and S3 of the electromagnetic switch 7 shown in FIG. 3 is put into a conduction (connection) state. Thereafter, the motor drive circuit 61*a* supplies a high three-phase ac power supply voltage (for instance, 300V) to the winding wire 5*c* of the motor 5*a* through the supply line L to thereby rotate the motor 5*a*. That is, the voltage generated by the ac power supply 11 is boosted by the inverter 61*a* configured in the control unit 61 and is supplied to the winding wire 5*c* of the motor 5*a*. Therefore, during an operation of the motor 5*a*, the electric shock guard means provided between the ac power supply 11 and each of the rotor 1 and the motor housing 5 is only the insulation provided on the motor 5*a*. However, during the operation of the motor 5*a*, the door 3 is closed and is locked.

Thus, a user of the centrifugal separator cannot touch the motor housing 5, the rotating shaft 5*b* of the motor 5*a*, and the rotor 1. On the other hand, the motor housing 5 is not electrically connected to the casing 10. This means that a second electric shock guard means is provided therein.

On the other hand, in a case where the operation of the centrifugal separator is stopped and where the door 3 is opened, for example, in a case where the control unit 61 cancels the lock by the door lock mechanism 4 and where the user opens the door 3, the control unit 61 receives a lock cancellation signal instructing the cancellation of the lock by the door lock mechanism 4 or an opening signal sent from the door opening/closing detector 12 and outputs a control signal to the control terminal CL thereby bringing each of the contact points S1, S2, and S3 of the switching unit 7 shown in FIG. 3 into a nonconduction state (an interruption state) and thereby interrupting the electric connection between the winding wire 5*c* of the motor 5*a* and the drive power supply.

When the door 3 is opened, a user may touch the rotating shaft 5*b* of the motor 5*a* and the rotor 1 electrically conducted to the rotating shaft 5*b*. However, according to the invention, the electrical connection between the drive power supply and the motor winding wire 5*c* is interrupted by the switching unit 7. Thus, in a state in which the door 3 is opened, the switching unit 7 functions as a second electric shock guard means.

Advantages of using the electromagnetic switch as the switching unit 7 inserted according to the invention are that the withstand voltage developed between both terminals of the switching unit 7 put in an opened state can be set at 1300V or higher, and that the floating capacity (the stray capacitance) Cs (see FIG. 3) between both terminals of the switching unit 7 in an interruption state (nonconduction state) can be made to be low. Especially, the use of the electromagnetic switch is advantageous in performing a high withstand voltage test on the centrifugal separator. Further, because of the low floating capacity Cs of the electromagnetic switch at the interruption, the use of the electromagnetic switch is advantageous in reducing a leakage current generated when a user touches the rotor or the rotating shaft of the motor 5*a*.

In a case where it is sufficient to use a switching unit 7 having a relatively low withstand voltage, an electronic switch constituted by a semiconductor switch using a transistor other than the electromagnetic switch may be used as such a switching unit 7.

The control of the switching unit 7 may be performed by the control unit 61 when the opening/closing of the door 3 is detected by the door opening/closing detector 12. Alternatively, the control of the switching unit 7 may be performed by the control unit 61 when the lock of the door is performed by the door lock mechanism 4, or when the cancellation of the lock of the door is detected. Alternatively, the switching unit 7 may be controlled to be brought in nonconduction when the control unit 61 does not drive the motor 5*a*.

In a case where the centrifugal separator is used in an environment in which grounding equipment is provided, as illustrated in FIG. 2, the casing 10 of the body of the centrifugal separator may be connected to the earth E through the ground connection wire 9. As is apparent from the foregoing description, according to the invention, the switching unit is inserted into the path of the motor drive power supply wire, the control of the opening/closing, that is, the conduction/nonconduction of electricity in the switching unit is performed by the control unit adapted to drive the motor. Thus, the leakage current of the centrifugal separator can be reduced. Also, the electric shock guard means can be doubled. Thus, the desired object of the invention can be achieved by employing a relatively simple configuration without using the double insulation structure or the reinforced insulation structure in the iron core or the rotating shaft of the motor and without being constrained by the shape and the material of the rotor for the centrifugal separator.

A second through a seventh embodiment of the invention will be explained in details in reference to the drawings as follows. Further, in all the drawings for explaining the embodiments, members having same functions are attached with the same notations and a repeated explanation thereof will be omitted.

Figure 7:
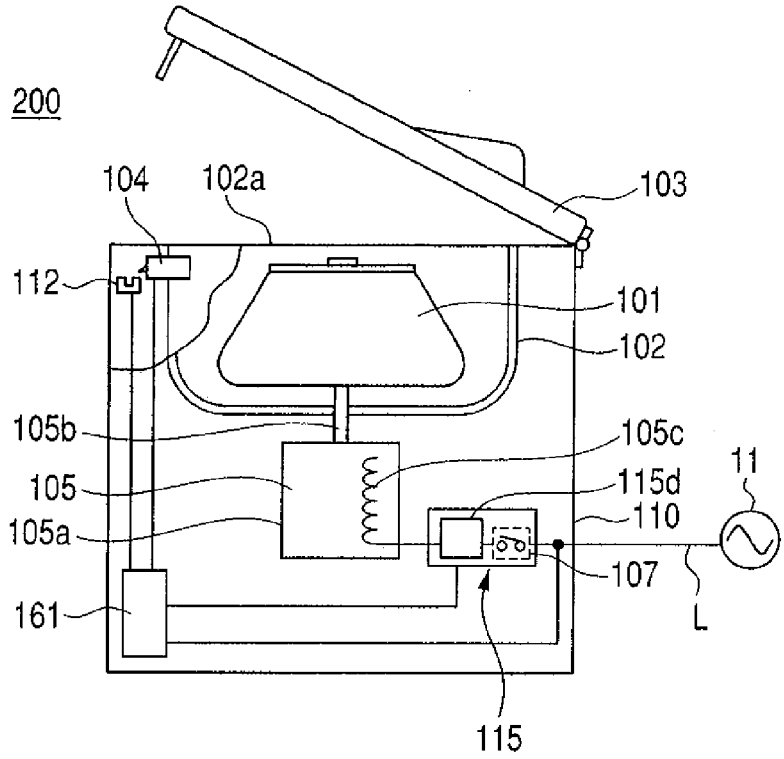
FIG. 7 is a constitution view of a centrifugal separator according to a second embodiment of the invention.
Figure 8:
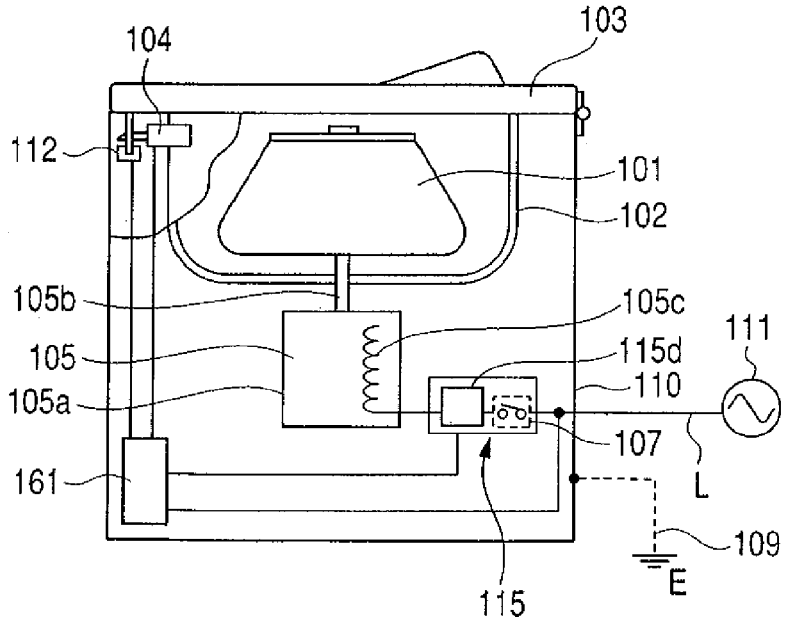
FIG. 8 is a constitution view showing a state of closing a door in the centrifugal separator according to the second embodiment of the invention.
Figure 9:
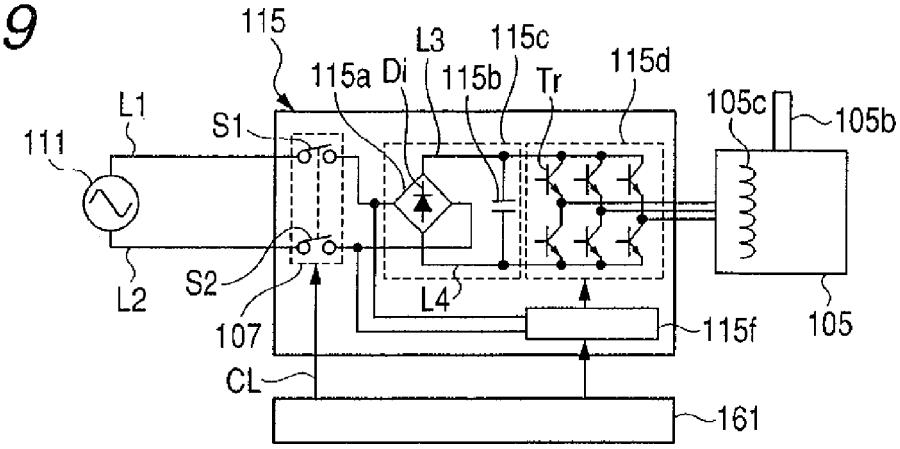
FIG. 9 is a constitution view of a main portion according to a centrifugal separator of a third embodiment of the invention.
Figure 13:
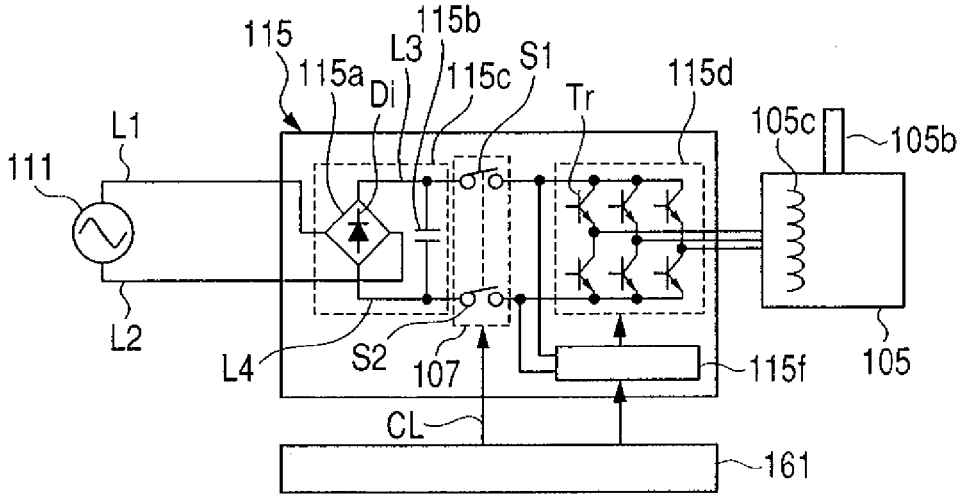
FIG. 13 is a constitution view of a main portion according to a centrifugal separator of a seventh embodiment of the invention.

FIG. 7 and FIG. 8 show constitution views of a centrifugal separator according to a second embodiment of the invention, particularly, FIG. 13 shows a view of a state in which an opening/closing apparatus 107 is brought into a nonconductive state, a motor 105 is stopped, and a rotor 101 is not rotated, FIG. 8 shows a view of a state when the opening/closing apparatus 107 is brought into a conductive state, the motor 105 is rotated and the rotor 101 is rotated, respectively. Further, FIG. 9 shows a third embodiment of a circuit diagram of an essential portion in the constitution view shown in FIG. 7.

A centrifugal separator 200 includes a housing (frame) 110 and includes the motor 105 constituting a rotation drive source integrated and contained at inside thereof. The motor 105 includes a housing (cabinet) 105*a* of a metal material, and an output rotating shaft (shaft) 105*b* comprising a metal material projected from the motor housing 105*a*, and a motor winding (field winding) 105*c* included in the motor housing 105*a* for exerting a rotation drive force to the output rotating shaft 105*b*.

Further, the centrifugal separator 200 includes the rotor 101 of the metal material (for example, aluminum alloy) fixed to the output rotating shaft 105*b* of the motor 105 for holding a sample subjected to centrifugal separation, a rotor chamber 102 containing the rotor 101 and having an opening portion 102*a* at an upper face thereof, a door 103 openably closeably provided to the opening portion 102*a* of the rotor chamber 102 formed at inside of the housing 110, a door lock mechanism 104 for restricting opening/closing of the door 103, a door opening/closing detector 112 for detecting opening/closing of the door 103, a motor drive circuit 115 for driving the motor 105, the opening/closing apparatus 107 electrically connected to a power supply line L (including L1 through L4 of FIG. 9) from a commercial alternating current power source 111 to the motor drive circuit 115, the motor drive circuit 115, the door lock mechanism 104, and a control circuit apparatus 161 for controlling the opening/closing apparatus 107. Further, according to the invention, a ground connecting line (corresponding to the connecting line 8 of the background art of FIG. 15) for electrically connecting the motor housing 105*a* to the housing 110 to dispense with.

The motor drive circuit 115 includes a power converting circuit 115*d* for converting an output voltage or a power source frequency or the like of the input alternating current power source (commercial power source) 111. According to the embodiment, as described later, as the power converting circuit 115*d*, the inverter 115*d* inputted with a direct current power source by a converter 115*c* is constituted.

As shown by FIG. 9, the motor 105 is constituted by, for example, a three phase induction motor in which the motor winding 105*c* is provided with a star connection or a delta connection and which is supplied with a three phase alternating current power. The invention achieves a significant effect when a polyphase motor is applied to the motor 105.

In FIG. 9, the motor 105 is constituted by the three phase induction motor started by a three phase alternating current power source of 300 V and an insulating layer is formed between the winding 105*c* and a core (not illustrated) of the motor 105 or at an outer peripheral face of the rotating shaft 105*b* or the like. Although not illustrated, the motor winding 105*c* comprises a star connection, and input sides of three pieces of the motor windings 105*c* are supplied with the three phase alternating current power source formed by the motor drive circuit 115.

The motor drive circuit 115 includes the converter 115*c* comprising a rectifying circuit 115*a* including 4 pieces of rectifying diodes Di connected to the input alternating current power source (commercial power source) 111 by bridge connection and a smoothing circuit 115*b*, and the inverter (power converting circuit) 115*d* for converting a direct current output of the converter 115*c* into a three phase alternating current output.

The converter 115*c* converts the alternating current power supply lines L1, L2 into the direct current power supply lines L3, L4. That is, the alternating current power source 111 supplied to the alternating current supply lines L1, L2 of the converter 115*c* comprise, for example, commercial alternating power source 100 V or 200 V (50/60 Hz), the converter 115*c* converts the alternating power source 111 into a direct current by the rectifying circuit 115*a* and the smoothing circuit 115*b* and supplies the direct current power source to the inverter 115*d* by way of the direct current power supply lines L3, L4. Here, the direct current power supply lines L3, L4 include also a supply line for supplying a rectified output of the rectifying circuit 115*a* forming the converter 115*c* to the smoothing circuit 115*b* and the opening/closing apparatus 107 may electrically be connected to the direct current power supply lines L3, L4 as shown by other embodiment of FIG. 12 and FIG. 13.

The inverter 115*d* converts the direct current output voltage of the converter 115*c* into, for example, a three phase alternating current power source 300 V (5 Hz through 2.6 kHz) and supplies a three phase alternating current power to the three phase motor windings 105*c*. The inverter 115*d* is constituted by 6 pieces of bridge elements Tr of bipolar transistors or IGBT (insulated gate bipolar transistors) connected in a three phase bridge style. A collector or an emitter of each switching element Tr is connected to the three phase windings of the motor windings connected by star connection and a base or a gate thereof is connected to the inverter drive circuit 115*f*. Thereby, 6 pieces of the switching elements Tr carry out switching operation by a switching element drive signal inputted from the inverter drive circuit 115*f* and supplies an output direct current voltage of the converter 115*c* applied to the inverter 115*d* as a three phase drive voltage to the motor windings (armature windings) 105*c* as a power. A well-known technology is applicable to the inverter 115*d*. The inverter drive circuit 115*f* is controlled by the control circuit apparatus 161.

The inverter drive circuit (interface circuit) 115*f* is constituted by a switching element of a bipolar transistor or the like and outputs a drive signal for driving the inverter 115*d*. The direct current voltage for driving the switching element of the inverter drive circuit 115*f* is supplied by a direct current power source circuit (not illustrated) for converting the alternating current power source 111 constituted at inside of the inverter drive circuit 115*f* into the direct current by the rectifying circuit according to the embodiment shown in FIG. 9. According to the embodiment shown in FIG. 9, the alternating current power source 111 supplied to the direct current power source circuit is branched from an output side of the opening/closing apparatus 107 (input side of rectifying circuit 115*a*). Thereby, when the opening/closing apparatus 107 becomes nonconductive, the drive power source is not supplied to the inverter drive circuit 115*f*, and therefore, standby power consumption of the inverter drive circuit 115*f* when the motor drive circuit 115 is brought into a stopped state can also be prevented. Further, the drive power source circuit (direct current power source circuit) of the inverter drive circuit 115*f* may branch to utilize the direct current voltage from the output side of the converter 115*c* as in other embodiment shown in FIG. 12.

Although not illustrated, the control circuit apparatus 161 includes a microcomputer comprising CPU for outputting a drive signal of the inverter drive circuit 115*f* based on a processing program and a data, ROM for storing a processing program or a control data, RAM for temporarily storing data, a timer and the like.

The opening/closing circuit 107 controls the power supply line L for supplying the alternating current power source 111 to the power converter 115*d* of the motor drive circuit 115 to be conductive (connected) or nonconductive (shut off) by a control signal applied to a control terminal CL from the control circuit apparatus 161. The opening/closing apparatus 107 may be constituted by an electromagnetic breaker (electromagnetic relay). An example shown in FIG. 9 shows a case of using the electromagnetic breaker 107 of two connection type (two contact type). The power supply lines L1, L2 of the drive power source (alternating current power source) 111 are connected with two contacts S1, S2 of the electromagnetic breaker 107 constituting the opening/closing apparatus, and the power is supplied to the power converter 115*d* by way of the contacts S1, S2. A control of making the respective switches S1, S2 of the electromagnetic breaker 107 conductive (connected) or nonconductive (shut off) is controlled by a control signal of the control circuit apparatus 161 applied to the control terminal CL.

Figure 10:
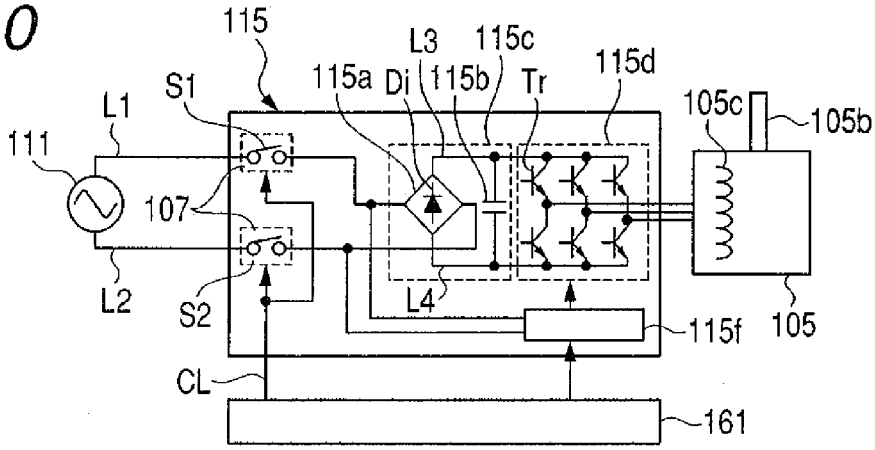
FIG. 10 is a constitution view of a main l portion according to a centrifugal separator of a fourth embodiment of the invention.
Figure 11:
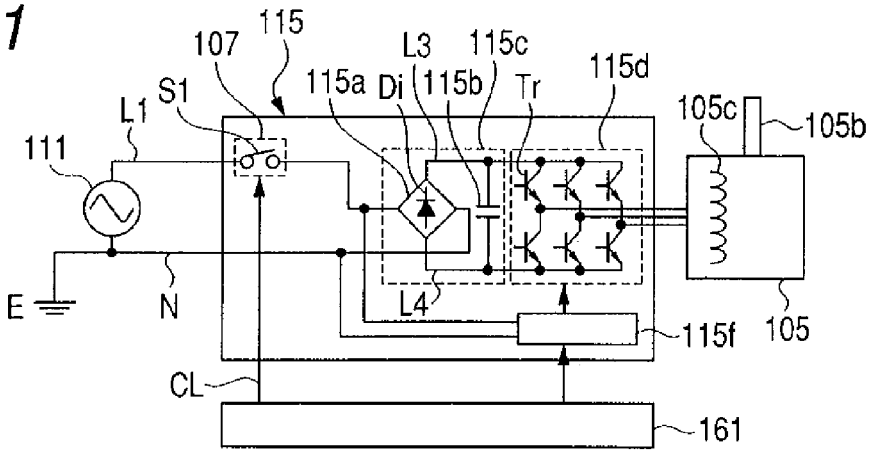
FIG. 11 is a constitution view of a main portion according to a centrifugal separator of a fifth embodiment of the invention.

FIG. 10 and FIG. 11 respectively show a second and a fifth embodiment of using the electromagnetic breaker as the opening/closing apparatus 107. The electromagnetic breaker 107 in a fourth embodiment of FIG. 10 is an example of using 1 contact type 2 pieces (S1, S2), and can be constituted similar to the case of FIG. 9. Further, according to a general commercial power source equipment, one piece of lines is constituted by a neutral line N which is grounded, and therefore, when the neutral line can be specified, as shown by a fifth embodiment of FIG. 11, the opening/closing apparatus can be constituted by the opening/closing apparatus 107 of 1 contact type 1 piece (S1).

Figure 12:
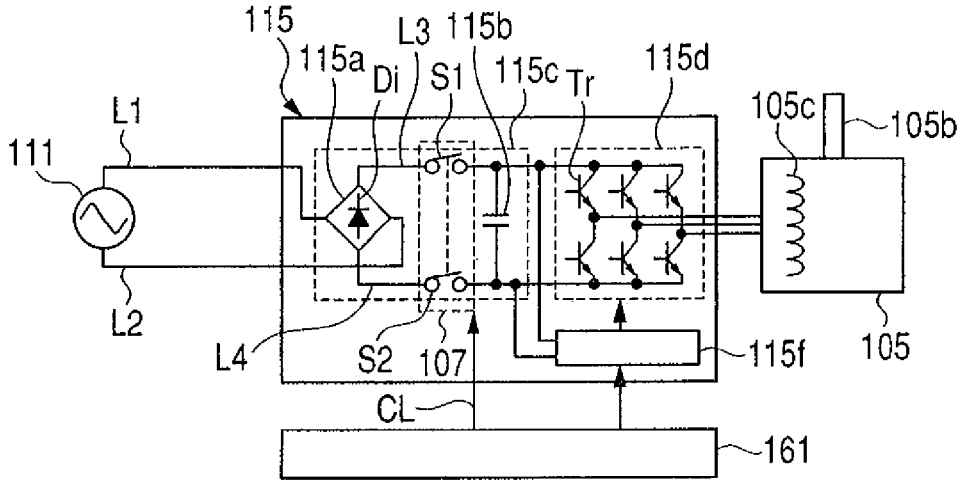
FIG. 12 is a constitution view of a main portion according to a centrifugal separator of a sixth embodiment of the invention.

Further, as shown by a fourth and a seventh embodiment of FIG. 12 and FIG. 13, the opening/closing apparatus 107 may electrically be connected to the direct current power source line L3, L4 (including a rectified current or pulsated current power supply line) forming the converter 115*c*. In FIG. 12 and FIG. 13, the opening/closing apparatus 107 is constructed by a constitution of a so-to-speak direct current power source input type which is connected to the direct current power source supply lines L3, L4 and in which the drive power source of the inverter drive circuit 115*f* is supplied by being branched from the power supply lines L3, L4 by way of the opening/closing apparatus 107. This differs from the alternating current power source input type in which the drive power source of the inverter drive circuit 115*f* is supplied by being branched from the alternating current power supply lines L1, L2 of the embodiments shown in FIG. 9 through FIG. 11.

In the embodiment shown in FIG. 12, an electric shock preventing effect similar to that of the embodiment shown in FIG. 9 can be achieved. Further, also the drive power source of the inverter drive circuit 115*f* is shut off by the opening/closing apparatus 107, and therefore, a standby power can be reduced. In this case, the standby power of the rectifying circuit 115*a* of the converter 115*c* is sufficiently smaller than that of other circuit, and therefore, power consumption does not substantially constitute a problem.

Also in the embodiment shown in FIG. 13, the electric shock preventing effect similar to that of the embodiment shown in FIG. 12 can be achieved. Similarly, a standby power when the opening/closing apparatus 107 is shut off can be reduced. In this case, a point more advantageous than that of the embodiment of FIG. 12 resides in that the smoothing circuit 115*b* stays to be conducted, and therefore, an await time period (for example, 0.5 through 1.0 second) until reaching a voltage (for example, 300 V) necessary for operating when the opening/closing apparatus 107 is conducted is dispensed with. Thereby, a drawback that a time period of accelerating the rotor is delayed can be avoided.

The embodiment becomes particularly advantageous by being applied to a centrifugal separator which needs to be accelerated in a short period of time.

Next, operation of the centrifugal separator 200 according to the embodiment will be explained. As shown by FIG. 8, the opening/closing apparatus (electromagnetic breaker) 107 is controlled to be brought into a conductive state by the control circuit apparatus 161 when the door 103 is brought into a close state at a stage of operating the centrifugal separator. When the door 103 is closed and the door opening/closing detector 112 detects the state of closing the door 103, or when the door is closed and the door is locked by the door lock mechanism 104, the respective contacts S1, S2 of the electromagnetic breaker 107 shown in the embodiments of FIG. 9 and the like are brought into a conductive state (connecting state). Thereafter, the motor drive circuit 115 supplies a high three phase alternating current power source voltage (for example, 300 V) to the motor winding 105*c* to rotate the motor 105. That is, the alternating current power source 111 is subjected to a frequency conversion by way of the drive motor drive circuit 115 and is supplied to the winding 105*c* of the motor 105. Therefore, in operating the motor 105, only a single insulation applied to the motor 105 is constituted among the alternating current power source 111 and the rotor 101 and the motor housing 105*a*, however, in operating the motor 105, the door 103 is closed and locked, and therefore, a user of the centrifugal separator 200 cannot touch the motor housing 105*a*, the rotating shaft 105*b* of the motor 105, or the rotor 101, and therefore, second electric shock preventing means is installed.

On the other hand, when the centrifugal separator 200 is stopped to be operated and the door 103 is opened as shown by FIG. 7, for example, after stopping to operate the motor 105, when a control circuit apparatus 161 releases the door lock mechanism 104 and the user opens the door 103, the control circuit apparatus 161 receives a lock release signal of the door lock mechanism 104 or an opening signal of the door opening/closing detector 112, outputs a control signal to the control terminal CL, brings the respective contacts S1, S2 of the opening/closing apparatus (electromagnetic breaker) 107 shown in FIG. 9 into the nonconductive (shut off) state to thereby shut off electric connection of the drive power source to the winding 105*c* of the motor 105*a*. When the door 103 is opened, although there is a possibility that the user touches the rotating shaft 105*b* of the motor 105, or the rotor 101 electrically conducted to the rotating shaft 105*b*, according to the invention, the electric connection of the drive power source (alternating current power source) to the motor winding 105*c* is shut off by the opening/closing apparatus 107, and therefore, in the state of opening the door 103, the opening/closing apparatus 107 functions as the second electric shock preventing means. Further, at this occasion, the rectifying circuit 115*a*, the smoothing circuit 115*b*, the inverter 115*d*, and the inverter drive circuit 115*f* are not supplied with power source from the alternating current power source 111 by making the opening/closing apparatus 107 nonconductive, and therefore, a standby power is not generated.

According to the embodiment, an advantageous point of using the electromagnetic breaker as the opening/closing apparatus 107 resides in that a withstand voltage across both ends of the opening/closing apparatus 107 in opening can be set to be 1300 V or higher, further, a floating capacitance (stray capacitance Cs) across the both ends when the opening/closing apparatus 107 is shut off (nonconductive) can be reduced. Particularly, when the electromagnetic breaker is used, it is advantageous when a high withstand voltage test of the centrifugal separator is carried out, further, according to the electromagnetic breaker, the floating capacitance (Cs) in being shut off is small, and therefore, it is advantageous also in that a leakage current generated when the user touches the rotor or the rotating shaft of the rotor can be reduced.

When the opening/closing apparatus 107 having a comparatively low withstand voltage may be used, other than the electromagnetic breaker, an electronic switch comprising a semiconductor switch of a transistor or the like may be used.

The control of the opening/closing apparatus 107 by the control circuit apparatus 161 may be carried out at a time point of detecting the opening/closing of the door 103 by the door opening/closing detector 112, or may be carried out at a time point of detecting door lock or release thereof by the door lock mechanism 103. Further, when the control circuit apparatus 161 does not drive the motor 105, the opening/closing apparatus 107 may be controlled to be nonconductive.

As shown by FIG. 8, when the centrifugal separator is used in an environment having a ground equipment, the housing 110 of the main body of the centrifugal separator may be connected to ground E by way of a ground connecting line 109.

As is apparent from the above-described explanation of the embodiment, according to the invention, double formation of the electric shock preventing means can be achieved by inserting the opening/closing apparatus into the power supply line of the motor drive circuit and controlling the conductive, nonconductive opening/closing control by the control circuit apparatus for driving the motor.

Figure 14:
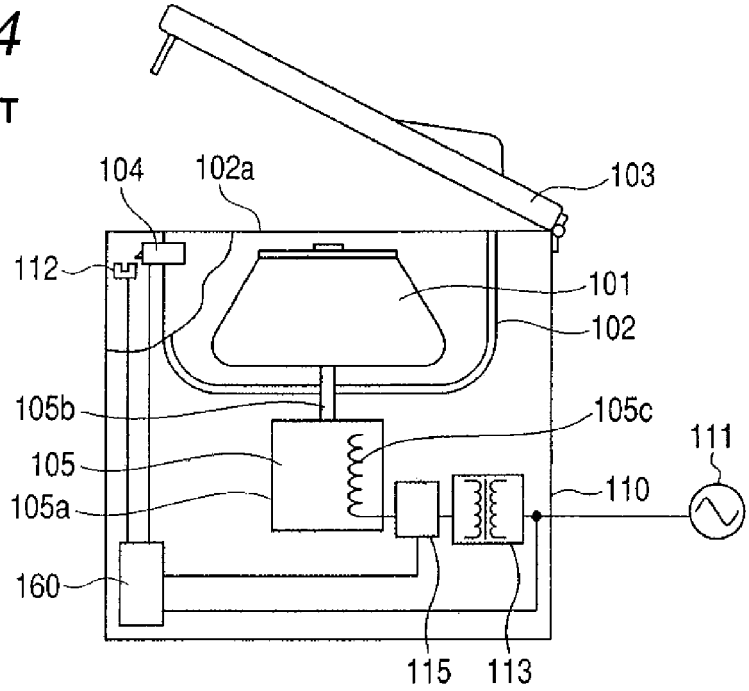
FIG. 14 PRIOR ART
FIG. 14 is a constitution view of a main portion according to a centrifugal separator showing other example of a related art.

In this case, consumption of standby power in stopping to operate the motor can be reduced and the comparatively simple opening/closing apparatus can be applied. Further, in the background art shown FIGS. 14, 15, the leakage current can be reduced. Further, in the background art shown in FIG. 15, the ground connecting line 108 of the motor can be eliminated. Here, FIG. 14 shows a constitution view of the centrifugal separator of the background art. The centrifugal separator includes the motor housing 105*a* constituting the housing of the motor 105 constituting a rotation drive source, the output rotating shaft (shaft) 105*b* of the motor 105, the rotor 101 holding sample to be separated, the rotor chamber 102 containing the rotor 101 and having the opening portion 102*a* at an upper face thereof, the door 103 openably and closeably provided at the opening portion 102*a* of the rotor chamber 102, the door lock mechanism 104 for restricting opening/closing of the door 103, the door opening/closing detector 112 for detecting opening/closing of the door, the motor drive circuit 115 for driving the motor 105, and the control circuit apparatus 160 for controlling the motor drive circuit 115, and the motor 105, the rotor chamber 102, the door lock mechanism 104, the motor drive circuit 115, and the control circuit apparatus 160 are contained in the housing (frame) 110.

According to the centrifugal separator, when the door 103 of the rotor chamber 102 is opened, there is a case in which a user touches the rotating shaft 105*b* of the motor 105, or the rotor 101 electrically conducted to the rotating shaft 105*b*.

Therefore, generally, an electric insulation layer is applied between the winding of the motor 105 and the rotating shaft 105*b* to prevent electric shock.

Figure 15:
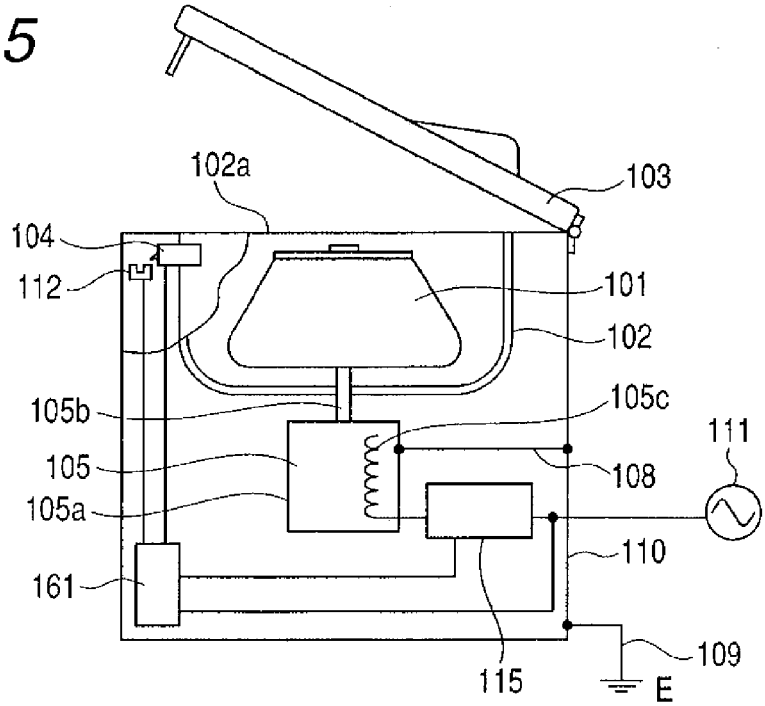
FIG. 15 PRIOR ART
FIG. 15 is a constitution view of a centrifugal separator showing still other example of a related art.

Further, in order not to generate a voltage at the rotating shaft 105*b* even when insulation layer is accidentally brought into insulation breakdown, as shown by FIG. 15, electric shock preventing means is doubled by electrically grounding to connect the housing 105*a* of the motor 105 electrically conducted to the shaft 105*b*. Normally, the housing 110 of the centrifugal separator is grounded by the ground E by the ground connecting line 109, and therefore, the ground connecting line 108 of the motor housing 105*a* is electrically connected to a portion of the housing 110 of the centrifugal separator disposed at a vicinity of the motor housing 105*a*. Further, the leakage current of the centrifugal separator is restricted to be equal to or smaller than a predetermined leakage current (for example, 3.5 mA or less) which does not effect a serious influence on the human body by a safety rule rectified by JIS (Japanese Industrial Standards) or IEC (International Electric standards Conference).

Further, it is obligated to install a plurality of electric shock preventing means for a member of a centrifugal separator having a possibility of being touched by a user. When an insulation is used as the electric shock preventing means, it is rectified to provide a high withstand voltage (for example, 1300 V or higher) at the insulation portion.

However, there is a case in which it is difficult to reduce the above-described leakage current within a restricted value depending on a structure of the motor 105 or a circuit constitution of the motor drive circuit 115. In this case, an insulation transformer 113 is used as shown by FIG. 14 as a general and firm leakage current reducing means. Or, when the ground connecting line 108 (refer to FIG. 15) constitutes a path of the leakage current, there is also a case in which the ground connecting line 108 is eliminated, thereafter, as other means for ensuring safety, there is carried out a method of subjecting the housing 105*a* per se of the motor to double insulation or intensified insulation by an insulating layer against winding.

According to the related arts shown in FIGS. 14, 15, the structure of using the insulation transformer 113 and the structure of subjecting the motor 105 to double insulation or intensified insulation poses a problem of increasing cost. Further, although JP-A-2006-198564 discloses a technical thought of inserting an opening/closing apparatus into a line of a motor drive power source system, with regard to a specific example of using a three phase induction motor as the drive motor, there is disclosed only an example of using three circuits of opening/closing apparatus in a drive output circuit for a motor winding. According to a technology of using three circuits of the opening/closing apparatus in the drive output circuit, there is a drawback that in order to maintain a state of conducting a power converting circuit of the motor drive circuit or a control circuit thereof, standby power consumption cannot be reduced.

However, according to the embodiment, there can be provided a centrifugal separator achieving double formation of a reduction in the leakage current and the electric shock preventing means by a comparatively simple constitution without using the insulation transformer having the high cost or the double insulation structure or the intensified insulation structure of the motor.

Further, according to the above-described embodiment, there can be provided a centrifugal separator for reducing the cost by constituting the opening/closing apparatus for shutting off the power source inserted into the power supply line of the motor drive power system by 2 circuits or less and reducing the standby power.

Further, according to the embodiment, a desired object can be achieved by a comparatively simple constitution without using a double insulation structure or the intensified insulation structure at the iron core or the rotating shaft of the motor, further, without being restricted to a shape and a material of the rotor for the centrifugal separator as well as the structure of the opening/closing apparatus.

Further, according to the constitution of the above-described embodiment, the opening/closing apparatus which is electrically conducted or nonconducted is inserted into the power supply line to the motor drive circuit, and therefore, a number of pieces of the opening/closing apparatus to be connected can be reduced or a structure thereof can be simplified. Thereby, the cost can be reduced by constituting the opening/closing apparatus for shutting off the power source inserted into the power supply line by two circuits or less and the standby power of the motor drive circuit can be reduced.

According to the constitution of the above-described embodiment, when the opening/closing apparatus which is electrically conducted or nonconducted is electrically connected to the power supply line of the motor drive circuit, the door of the centrifugal separator is opened and a user is brought into a state of being able to touch the rotor or the motor rotating shaft, by making the opening/closing apparatus nonconductive, double formation of electric shock preventing means accompanied by insulation of the motor can be achieved. Thereby, there can be provided the centrifugal separator dispensing with addition of the insulation transformer or double insulation or intensified insulation of the motor as in the background art and reducing cost by a simple constitution. On the other hand, although when the motor is operated, the opening/closing apparatus is made to be conductive, when the door of the centrifugal separator is closed, the door is locked such that the user cannot touch the rotor or the motor rotating shaft, and therefore, double formation of the electric shock preventing means accompanied by insulation of the motor can be achieved.

Further, according to the constitution of the embodiment, particularly, the electric breaker can be used as the opening/closing apparatus, and therefore, when the electric breaker is not conducted, a high withstand voltage (for example, 1300 V or higher) which is necessitated across the opening/closing terminals can easily be achieved as electric shock preventing means. Further, in comparison with the opening/closing apparatus by an electronic switch of a transistor or the like, the floating capacitance (stray capacitance) across the opening/closing terminals can be reduced, and therefore, the leakage current generated when the user touches the rotor or the rotating shaft of the motor when stopped can easily be restrained to be equal or smaller than a value rectified by the safety rule of JIS or IEC.

Although as described above, an explanation has been given of the embodiment carried out by the inventors based on the embodiment, the invention is not limited to the embodiment but can variously be modified within the range not deviated from the gist. Although according to the embodiment, the three phase motor is used as the motor, other motor of two phase motor or the like can be applied other than the three phase motor. Further, a signal subjected to PWM modulation (pulse width modulation) may be used for the drive signal of the inverter drive circuit.

Further, by using a power source transformer on an input side of the power converting circuit, the input alternating current power source can be changed in the voltage.

Although the invention accomplished by the present inventors has been described according to the embodiments, the invention is not limited to the aforementioned embodiments. Various modifications may be made without departing the gist of the invention.

What is claimed is:

1. A centrifugal separator comprising:

a motor having an output rotating shaft and a motor winding for exerting a rotation drive force to the output rotating shaft;

a rotor connected to the output rotating shaft for holding a sample to be separated;

a rotor chamber containing the rotor and having an opening portion at an upper face thereof;

a door openably and closably provided to the opening portion for opening or closing the opening portion of the rotor chamber;

a door lock mechanism for restricting opening/closing of the door;

a motor drive circuit having a power converting circuit for supplying a drive power source to the motor winding;

a control circuit apparatus for controlling the door lock mechanism and the motor drive circuit;

a housing containing the rotor chamber, the door lock mechanism, the motor drive circuit, and the control circuit apparatus and mounted with the door in correspondence with the opening portion of the rotor chamber; and an opening/closing apparatus electrically connected to a power supply line to the power converting circuit of the motor drive circuit and made to be electrically conductive or nonconductive, wherein the control circuit apparatus makes the opening/closing apparatus nonconductive when the door lock mechanism does not lock the door, wherein the motor drive circuit includes a converter electrically connected to a power supply line to the power converting circuit for converting an alternating current power supply line into a direct current power supply line, said converter including a rectifying circuit and a smoothing circuit, wherein the direct current power supply line includes a supply line for electrically connecting a rectified output of the rectifying circuit to the smoothing circuit, and wherein the opening/closing apparatus is electrically connected to the supply line between the rectifying circuit and the smoothing circuit.

2. The centrifugal separator according to claim 1, wherein the power converting circuit comprises:

an inverter for converting a direct current into an alternating current to supply to the motor winding as a drive power source.

3. The centrifugal separator according to claim 2, wherein the opening/closing apparatus is electrically connected to the direct current power supply line for electrically connecting the converter to the inverter.

4. The centrifugal separator according to claim 3, wherein the motor drive circuit further includes an inverter drive circuit for making the inverter execute a switching operation; and wherein a drive power source of the inverter drive source circuit is supplied from the direct current power supply line of the converter, when the opening/closing apparatus becomes nonconductive, the supply of the drive power source from the direct current power supply line is stopped.

5. The centrifugal separator according to claim 2, wherein the motor winding of the motor is constituted by a three phase winding, and the inverter supplies a three phase alternating current power to the motor winding.

6. The centrifugal separator according to claim 5, wherein the motor is constituted by a three phase induction motor.

7. The centrifugal separator according to claim 1, wherein the control circuit apparatus controls the opening/closing apparatus to be nonconductive when the motor drive circuit is not controlled.

8. The centrifugal separator according to claim 1, wherein the opening/closing apparatus is an electromagnetic breaker.

9. The centrifugal separator according to claim 1, wherein the motor includes a motor housing; and wherein the motor housing is contained at inside of the housing by being electrically separated from the housing.

10. The centrifugal separator according to claim 1, wherein the rotor is formed by a metal material.

11. A centrifugal separator comprising:

a motor having an output rotating shaft and a motor winding for exerting a rotation drive force to the output rotating shaft;

a rotor connected to the output rotating shaft for holding a sample to be separated;

a rotor chamber containing the rotor and having an opening portion at an upper face thereof;

a door openably and closably provided to the opening portion for opening or closing the opening portion of the rotor chamber;

a door opening/closing detector for detecting opening/closing of the door;

a motor drive circuit having a power converting circuit for supplying a drive power source to the motor winding;

a control circuit apparatus for controlling the motor drive circuit based on a detecting signal at the door opening/closing detector;

a cabinet housing containing the rotor chamber, the door opening/closing detector, the motor drive circuit, and the control circuit apparatus and mounted with the door in correspondence with the opening portion of the rotor chamber; and an opening/closing apparatus electrically connected to a power supply line to the power converting circuit of the motor drive circuit and made to be electrically conductive or nonconductive;

wherein the control circuit apparatus makes the opening/closing apparatus nonconductive when the door is opened, wherein the motor drive circuit includes a converter electrically connected to the power supply line to the power converting circuit for converting an alternating current power supply line into a direct current power supply line, the converter including a rectifying circuit and a smoothing circuit, wherein the direct current power supply line includes a supply line for electrically connecting a rectified output of the rectifying circuit to the smoothing circuit, and wherein the opening/closing apparatus is electrically connected to the supply line between the rectifying circuit and the smoothing circuit.

12. A centrifugal separator comprising:

a motor having an output rotating shaft;

a rotor connected to the output rotating shaft for holding a sample to be separated;

a rotor chamber containing the rotor and having an opening portion at an upper face thereof;

a door adapted to open or close the opening portion of the rotor chamber;

a door lock mechanism for restricting opening/closing of the door;

a motor drive circuit for supplying a drive power source to a winding of the motor, the motor drive circuit including a rectifying circuit for rectifying an AC voltage of an AC power source into a DC voltage, a smoothing circuit which is supplied with a rectified output of the rectifying circuit, and an inverter for converting an output of the smoothing circuit into an AC voltage which is supplied to the motor winding;

a control circuit apparatus for controlling the door lock mechanism and the motor drive circuit; and an opening/closing apparatus electrically connected between the rectifying circuit and the smoothing circuit, wherein the control circuit apparatus makes the opening/closing apparatus nonconductive when the door lock mechanism does not lock the door.

13. A centrifugal separator comprising:

a motor having an output rotating shaft;

a rotor connected to the output rotating shaft for holding a sample to be separated;

a rotor chamber containing the rotor and having an opening portion at an upper face thereof;

a door adapted to open or close the opening portion of the rotor chamber;

a door lock mechanism for restricting opening/closing of the door; a motor drive circuit for supplying a drive power source to a winding of the motor, the motor drive circuit including a rectifying circuit for rectifying an AC voltage of an AC power source into a DC voltage, a smoothing circuit which is supplied with a rectified output of the rectifying circuit, and an inverter for converting an output of the smoothing circuit into an AC voltage which is supplied to the motor winding;

a control circuit apparatus for controlling the door lock mechanism and the motor drive circuit; and an opening/closing apparatus electrically connected between the smoothing circuit and the inverter, wherein the control circuit apparatus makes the opening/closing apparatus nonconductive when the door lock mechanism does not lock the door.

14. A centrifugal separator comprising:

a motor having an output rotating shaft;

a rotor connected to the output rotating shaft for holding a sample to be separated;

a rotor chamber containing the rotor and having an opening portion at an upper face thereof;

a door adapted to open or close the opening portion of the rotor chamber;

a door lock mechanism for restricting opening/closing of the door;

a motor drive circuit for supplying a drive power source to a winding of the motor, the motor drive circuit including a rectifying circuit for rectifying an AC voltage of an AC power source into a DC voltage, a smoothing circuit which is supplied with a rectified output of the rectifying circuit, and an inverter for converting an output of the smoothing circuit into an AC voltage which is supplied to the motor winding;

a control circuit apparatus for controlling the door lock mechanism and the motor drive circuit; and an opening/closing apparatus electrically connected between the AC power source and the rectifying circuit, wherein the control circuit apparatus makes the opening/closing apparatus nonconductive when the door lock mechanism does not lock the door.

* * * * *